US005171107A

United States Patent [19]

Hamilton et al.

[11] Patent Number: 5,171,107

[45] Date of Patent: * Dec. 15, 1992

[54] METHOD OF UNDERPINNING EXISTING STRUCTURES

[75] Inventors: Daniel Hamilton; Robert M. Hoyt, both of Centralia; Patricia Halferty, Columbia; J. Thomas Odom, Centralia, all of Mo.

[73] Assignee: A. B. Chance Company, Centralia, Mo.

[ * ] Notice: The portion of the term of this patent subsequent to Aug. 18, 2009 has been disclaimed.

[21] Appl. No.: 861,999

[22] Filed: Apr. 1, 1992

Related U.S. Application Data

[63] Continuation of Ser. No. 623,603, Dec. 7, 1990, Pat. No. 5,139,368, which is a continuation-in-part of Ser. No. 464,937, Jan. 16, 1990, Pat. No. 5,011,336.

[51] Int. Cl.[5] ..... E02D 5/00

[52] U.S. Cl. ..... 405/230; 405/229

[58] Field of Search ..... 405/230, 229; 52/169.5

[56] References Cited

U.S. PATENT DOCUMENTS

| | | | |
|---|---|---|---|
| 3,786,641 | 1/1974 | Turzillo | 405/230 |
| 3,796,055 | 3/1974 | Mahony | 405/230 |
| 3,902,326 | 9/1975 | Langenbach, Jr. | 405/229 X |
| 4,070,867 | 1/1978 | Cassidy | 405/230 X |
| 4,634,319 | 1/1987 | May | 405/230 |
| 4,673,315 | 6/1987 | Shaw et al. | 405/229 X |
| 4,695,203 | 9/1987 | Gregory | 405/230 |
| 4,708,528 | 11/1987 | Rippe | 405/230 |
| 4,765,777 | 8/1988 | Gregory | 405/230 |
| 4,854,782 | 8/1989 | May | 405/230 |
| 4,911,580 | 3/1990 | Gregory | 405/230 |
| 4,925,345 | 5/1990 | McCown, Jr. et al. | 405/230 X |
| 5,011,336 | 4/1991 | Hamilton et al. | 405/229 X |

*Primary Examiner*—David H. Corbin
*Assistant Examiner*—J. Russell McBee
*Attorney, Agent, or Firm*—Hovey, Williams, Timmons & Collins

[57] ABSTRACT

A low cost, easy to install underpinning apparatus (14) for supporting below-grade structural footings such as foundations (10) or the like is provided which makes use of a power installed, load-bearing helix-type screw anchor (16) together with a connecting bracket assembly (b 19) secured to the foundation (10). The anchor (16) is screwed into the earth below the foundation (10), leaving the upright end of the anchor shaft (20) adjacent the foundation (10). The bracket assembly (18) advantageously includes a foundation-engaging plate (28) with a pair of spaced, outwardly extending wall portion (30, 32) rigidly secured thereto. An elongated, U-shaped bracket (36) together with a mating retainer (42) are releasably secured to the wall portions (30, 32) and serve to captively retain the upper end of the anchor shaft (20), with the U-bracket (36) having a top crosspiece wall (38) provided with a threaded opening (40) therethrough. A threaded, force-transmitting bolt (54) screwed into the bracket crosspiece (38) engages the uppermost butt end (22) of the anchor shaft (20) so that the anchor (16) becomes a load-bearing support for the foundation (10). Rotational torque is imparted to each screw anchor during installation as a force independent of a respective support and the foundation until a predetermined torque value is achieved. The rotational torque on the screw anchor is then relieved and the dead weight and any live load of the building structure carried by the bracket assembly is transferred to the screw anchor.

8 Claims, 3 Drawing Sheets

METHOD OF UNDERPINNING EXISTING STRUCTURES

This is a continuation application of application Ser. No. 07/623,603, filed on Dec. 7, 1990, which is a continuation-in-part of application Ser. No. 07/464,937, filed on Jan. 16, 1990, now U.S. Pat. No. 5,011,336.

BACKGROUND OF THE INVENTION

1. Field of the Invention

The present invention is broadly concerned with an improved anchor apparatus designed to support and resist settling of structural foundations or footings such as floors and the like. More particularly, it is concerned with a method and apparatus for stabilizing the below-grade foundation of an existing building structure having a predetermined weight and which may or has experienced settlement or movement. In addition, the structure is subject to variable live loads which are factored into equations allowing calculation of an assummed live load for the structure in that particular geographical location. In accordance with the invention, use is made of a power installed earth anchor driven adjacent a footing to be supported, together with a bracket assembly particularly suited for attachment to an exterior corner surface of the footing serving to couple the footing and anchor shaft so that the anchor becomes a load-bearing support for the footing.

2. Description of the Prior Art

Many homeowners face the disconcerting and oftentimes expensive problem of foundation settling. This phenomenon can arise by virtue of loose, sandy soil around the foundation, undue moisture conditions, expansive soils or improper original construction of the foundation. In any case, solving the settling problem and properly supporting the foundation (and usually the basement floor) is typically a very involved and costly proposition.

Various techniques have been proposed in the past for supporting below-grade structural footings. For example, U.S. Pat. No. 2,982,103 describes a system wherein a bracket is attached to the basement walls, and a hole is bored through the adjacent floor. Elongated pipe sections are hydraulically driven downwardly through the floor until a bearing region such as bedrock is reached, whereupon the pipe sections are coupled to the wall-mounted bracket. Such systems are very costly to install. Additional patents describing various underpinning methods using hydraulic rams are described in U.S. Pat. Nos. 3,902,326, 3,796,055, 3,852,970, and 4,634,319.

U.S. Pat. Nos. 4,673,315 and 4,765,777 are exemplary of prior practices and systems wherein a piling is driven into the ground using a hydraulic ram until the piling encounters a predetermined resistance whereupon the ram is further actuated to raise the foundation or a slab a predetermined distance.

In addition, it has been known in the past to use embedded earth anchors as a means of supporting foundations or footings. For instance, anchors have been installed vertically beneath a footing, with plural anchors being interconnected with reinforced concrete. In other instances, plural anchors have been driven at various angles and tied together to the footing with reinforcing bars or hairpin connectors; such connection structure then being cast in concrete.

Despite these prior attempts, however, there is a distinct need in the art for an improved, easy to install system for providing load-bearing support for structural footings. Advantageously, such a system should be low in cost and readily installable from the outside of a house or other structure.

SUMMARY OF THE INVENTION

The present invention overcomes the problems outlined above by provision of an improved foundation support and screw anchor assembly adapted to be positioned at strategic locations along the length of the foundation. Rotational force is imparted to the screw anchor until a predetermined resistance is sensed, whereupon the rotational torque on the screw anchor is relaxed and the shaft of the screw anchor is then connected to a respective support which has been placed in supporting relationship to the foundation. The underpinning method and apparatus makes use of a high-strength embedded screw anchor presenting an upstanding anchor shaft, together with novel attachment bracket structure serving to operatively interconnect the anchor shaft and a structural footing in order that the anchor becomes a load-bearing support.

Broadly speaking, the method of the invention in a preferred form—involves the steps of first excavating earth down to at least the level of the footing (and usually somewhat lower) and for a distance away from the footing so as to provide working clearance. Next, one or more earth anchors each equipped with an elongated shaft presenting an earth-penetrating tip and a transversely extending load-bearing member (e.g., a helix section) is placed in the earth adjacent the footing; the anchor(s) are then rotated and screwed into the earth below the footing until the upper end of the shaft is adjacent the footing and a predetermined resistance to rotation of the anchor has been achieved. If necessary, extensions may be added to the anchor shaft so that the screw anchor may be driven into the ground until a predetermined resistance to rotation thereof is sensed and the upper end of the anchor shaft is strategically located adjacent the part of the foundation to be engaged by the foundation support. Upon release of rotational torque on the anchor shaft so that the anchor may return to its unstressed state, the anchor shaft and foundation and/or footing are connected via a bracket assembly to establish the desired load-bearing relationship.

In the method, it is possible to install a foundation engaging plate of the bracket assembly prior to installation of each earth anchor in order that the plate serves as a guide for positioning the earth anchor during rotation of the elongated shaft thereof.

The preferred bracket assembly includes means adapted for securement to the structural footing at a below-grade location, together with attachment means including structure for receiving and captively retaining the upper end of the anchor shaft, such including structure defining a threaded opening adjacent the shaft. The plate means and shaft-retaining structure are operatively connected, and a threadably shiftable, force-transmitting bolt is placed within the threaded opening and rotated to engage the anchor shaft and establish the load-bearing relationship. Advantageously, the footing-engaging plate means is in the form of a somewhat L-shaped metallic plate adapted for footing securement by means of bolts, with a pair of outwardly extending, spaced apart walls rigidly secured to the L-shaped plate. These walls are preferably spaced by a distance sufficient to permit the walls to serve as a guide for orienting the elongated shaft of an earth anchor during installation thereof. The attachment means preferably includes an elongated generally U-shaped bracket which, together with a mating wedge-shaped retainer, captively receives the upper end of the anchor shaft. The U-shaped bracket includes a top cross plate provided with a threaded aperture therethrough; the force-transmitting bolt is installed through this aperture, and engages the uppermost butt end of the anchor shaft.

DESCRIPTION OF ONE EMBODIMENT

Figure 5:
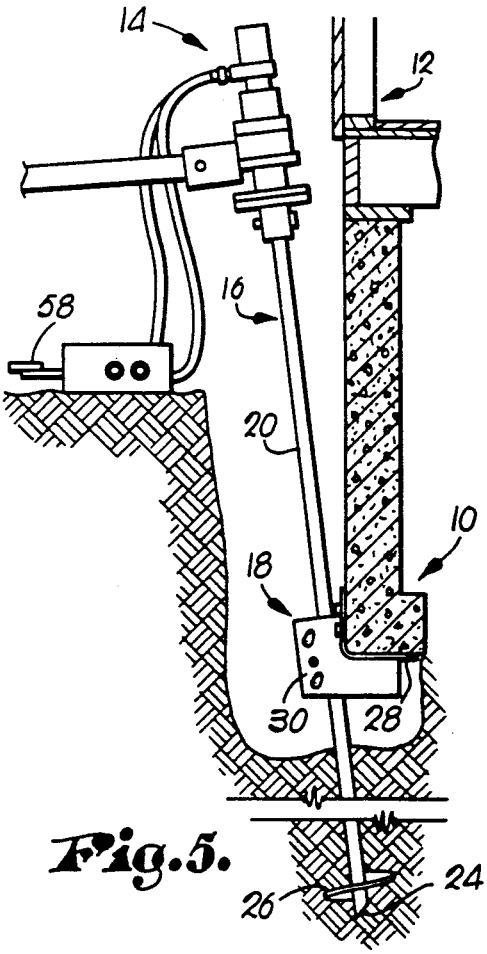
FIG. 5 is a sectional view illustrating the preferred manner of anchor installation in accordance with the invention.

Turning first to FIG. 5 of the drawings, it will be seen that the present invention contemplates a method and apparatus for supporting a below-grade structural footing such as the poured concrete floor/wall foundation 10 forming a part of a house 12 or other similar structure. The building structure has a predetermined weight and is subject to determinable live loads which may be calculated to give an assumed effective live load for a particular geographical location. In general, the invention makes use of a number of anchoring assemblies broadly referred to by the numeral 14, each including an elongated earth anchor 16, as well as a bracket assembly 18 serving to place the earth anchor, when embedded, in supporting, load-bearing relationship to the foundation 10.

In more detail, earth anchor 16 is of conventional design and includes an elongated metallic anchor shaft 20 which may have a square cross-sectional shape and presenting an uppermost butt end 22 (see FIG. 3) as well as an opposed, earth-penetrating tip 24. The anchor further includes a transversely extending load-bearing member, preferably a metallic helix section 26 secured to shaft 20 adjacent tip 24.

Figure 1:
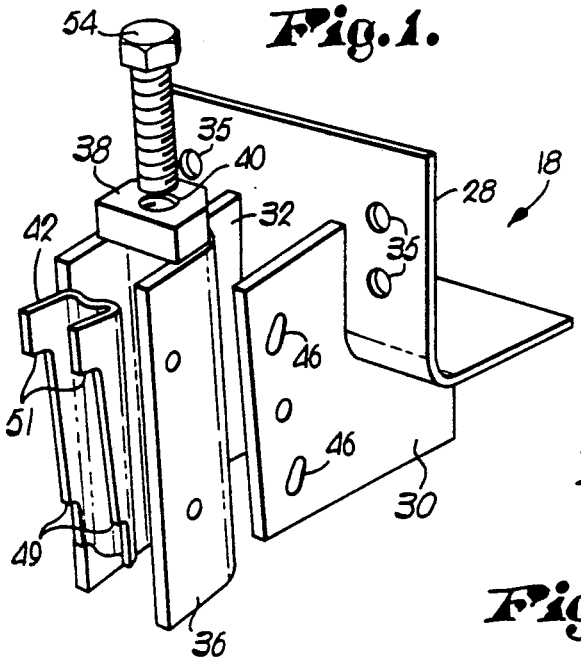
FIG. 1 is a perspective, exploded view of a bracket assembly in accordance with the invention.
Figure 2:
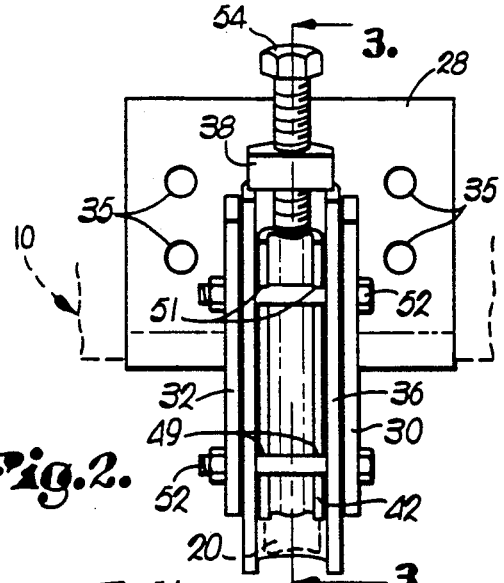
FIG. 2 is an elevational view of the bracket assembly of FIG. 1, shown as installed and operatively interconnected with the upper end of an anchor shaft (shown in phantom) captively retained by the assembly.
Figure 3:
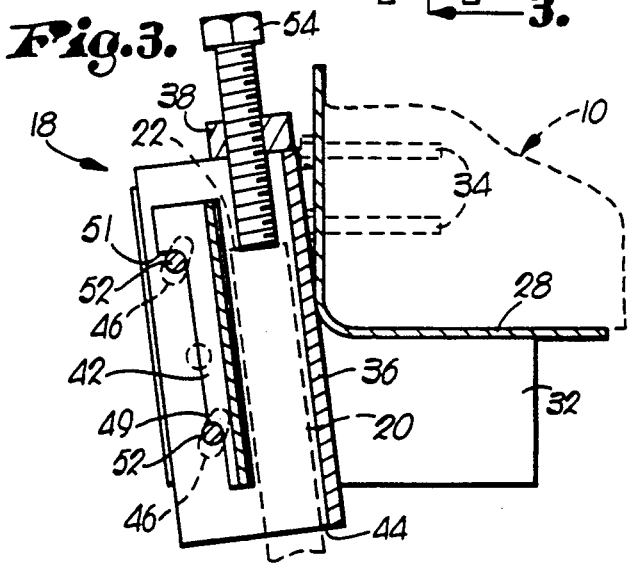
FIG. 3 is a sectional view taken along the line 3—3 of FIG. 2.

As shown in FIG. 1, the foundation support in the form of a bracket assembly 18 includes an apertured, somewhat L-shaped foundation-engaging plate 28 having a pair of spaced apart, generally parallel, apertured walls 30, 32 secured to the convex face thereof. As best seen in FIGS. 2 and 3, plate 28 is adapted to mate with and engage a lower external edge of the foundation 10, and be permanently attached thereto by means of bolts 34 extending through oversized apertures 35 in the plate 28 and into the foundation material.

The assembly 18 further comprises a primary bracket 36 of elongated, generally U-shaped configuration and provided with a top cross plate 38. The latter includes a threaded opening 40 extending in the direction of the longitudinal axis of the primary bracket 36. This threaded opening 40 is important for purposes to be described. A somewhat W-shaped, elongated retainer 42 is designed to nest within primary bracket 36 and to cooperatively define therewith an elongated, anchor shaft-receiving space 44.

Interconnection of the plates 30, 32, and the primary bracket 36 is afforded by means of corresponding apertures 46 and 48 provided in the plates 30, 32 and the primary bracket 36 respectively. The retainer is wedge shaped in the direction of the longitudinal axis thereof and includes steps 49, 51 that cooperatively mate with transverse bolts 52 extending through the apertures 46 and 48 to define the described shaft-receiving space 44.

A heavy-duty, force-transmitting bolt 54 also forms a part of the overall invention, and is designed to be threadably received within opening 40.

Figure 4:
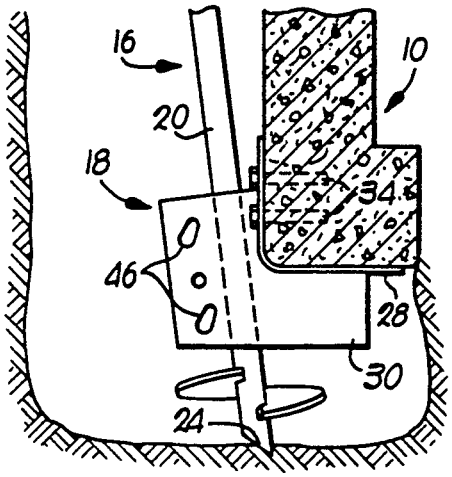
FIG. 4 is an elevational view showing the bracket assembly of the invention secured to a below-grade foundation, during the initial stages of anchor installation.

In the use of the anchoring assemblies 14, earth is excavated exteriorly of foundation 10 and down to at least the level of the footing region thereof. As shown in FIGS. 4 and 5, preferably the excavation is carried downwardly somewhat below the floor of the foundation. In any event, sufficient earth is excavated so as to provide adequate working clearance at the base of the foundation 10.

At this point, the soil beneath the foundation 10 is tested by conventional means so that the installer can properly calculate the number, spacing and depth of the assemblies 14 needed for properly supporting the foundation. Such calculations and considerations are entirely conventional and well within the skill of the art.

Next, the bracket assemblies 18 are secured to the foundation 10 as required, such involving first placing the plates 28 in engagement with the lower edge of foundation 10 after breaking out the footing so that the bracket is disposed directly beneath the foundation wall. This steps is followed by securing the bracket assemblies to the foundation by means of bolts 34. Preferably, the apertures 35 are somewhat oversized relative to the bolts 34 so that, once installed, some minor settling of the plate 28 may occur without placing a shearing force on the bolts 34. Alternately, vertical slots could be formed in place of the oversized apertures 35 in order to take up any settling movement of the plate that might occur during installation of the assembly.

An anchor 16 is then installed below each plate 28, by first positioning tip 24 at the bottom of the excavation with shaft 20 extending upwardly between the plates 30, 32. In this regard, it is preferred to place the anchor at a slight angle with respect to the vertical (e.g., 5'-9") so that the load-bearing helix 26 of the anchor will be positioned directly beneath the foundation once installed. In any event, a conventional, hydraulically or electrically operated anchor wrench device 56 (see FIG. 5) is secured to the upper end of anchor shaft 20. Actuation of the device 56 by means of foot switch 58 serves to rotate the anchor and thus screw it into the earth.

When the anchor 16 is fully installed in the earth below foundation 10, the upper end of shaft 20 will be situated between the plates 30, 32. Any excess length of shaft extending above these plates can simply be removed by a cutting torch or other convenient means. Primary bracket 36 is then slipped over the uppermost end of shaft 20, and bolts 52 are used to interconnect the primary bracket 36 with the plates 30, 32 by passage of such bolts through the aligned apertures 46, 48.

Preferably, the apertures 46 are egg-shaped or slots such that the bolts 52 can be positioned through the lower ends of the apertures 46 when the primary bracket is initially secured to the plates 30, 32 and will work upward and slightly inward toward the L-shaped plate 28 when lifting pressure is applied to the top end 22 of the elongated shaft 20. This movement of the primary bracket between the plates 30, 32 serves to lock the bolts 52 in place. Further, by providing the enlarged apertures 46, it is easier to align the apertures 46, 48 when the primary bracket is initially positioned over the upper end of the shaft 20.

After the bolts 52 are installed, the retainer 42 is driven downward into the space defined between the bolts 52 and the shaft 20 until firmly wedged therebetween, thus improving the fit between the assembly 18 and the shaft 20. The W-shape of the retainer 42 serves to provide a good fit between the assembly 18 and shaft 20 regardless of the rotational orientation of the shaft 20 in the assembly. After wedging the retainer 42 into position, the bolts 52 are tightened to secure the components 36, 42 between the plates 30, 32 such that the bracket assembly 18 captively retains the uppermost end of shaft 20 within the space 44. It is not necessary that a frictional or mechanical connection be established between the assembly 18 and shaft 20.

Assembly 14 is completed by threading bolt 54 into aperture 40 and rotating the same until the end of the bolt engages butt end 22 of shaft 20, as shown in FIG. 3. As will be readily appreciated, continued rotation of the bolt 54 progressively transmits foundation loads to anchor 16 until the desired degree of foundation support is achieved. Such rotation of the bolt 54 is normally accomplished by means of an elongated, high mechanical advantage socket wrench. Typically, where a plurality of assemblies 14 are used, the respective volts 54 thereof would be sequentially rotated in an incremental fashion until the desired degree of support is obtained.

During the initial stage of rotation of the bolt 54, some settling of the L-shaped plate 28 occurs which is permitted by the provisions of the oversized apertures 46 therein. Further, upward and inward movements of the primary bracket 36 occurs relative to the plates 30, 32 due to the movement of the bracket 36 and bolts 52 in the slots or egg-shaped apertures 46. This movement, as mentioned, locks the bolts 52 in place and pulls the bracket inward toward the foundation slightly so as to remove slop from the assembly and provide a good fit between the assembly 18 and the shaft 20.

Further, as the elongated shaft moves downward relative to the primary bracket 36 during rotation of the bolt 54, the retainer 42 is pulled along such that the retainer becomes further wedged in place between the shaft 20 and the bolts 52. This is significant where a square cross-section shaft is employed since, depending on the orientation of the shaft in the space 44, the retainer must isolate the shaft 20 beneath the bolt 54.

Figure 6:
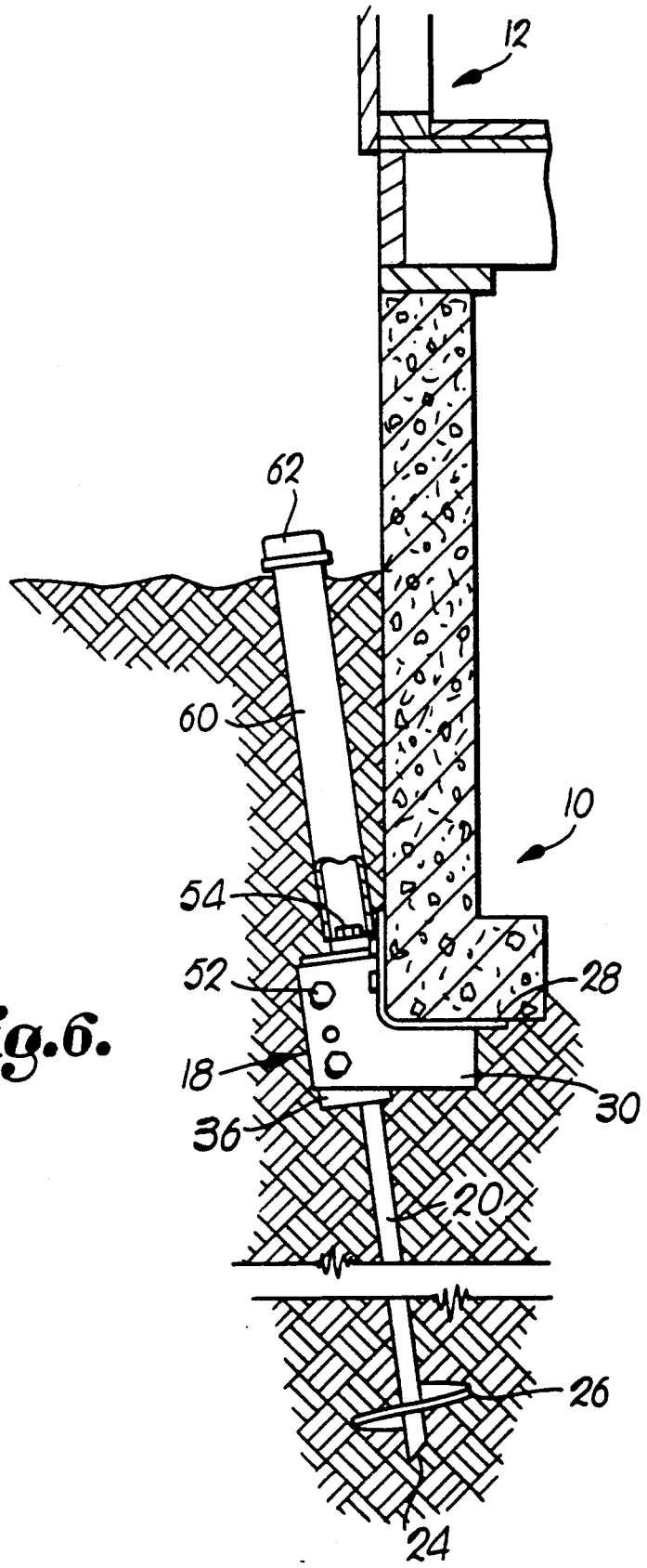
FIG. 6 is a sectional view illustrating the disposition of the bracket assembly and anchor shaft after installation thereof, with an access pipe shown extending between a force-transmitting bolt and an above ground opening.

After all of the foregoing operations have been completed, the excavated earth is replaced as shown in FIG. 6, and the bracket assembly 18 and anchor shaft 20 are left in place to provide support to the foundation and/or footing 10. If desired, a tube 60 can be positioned immediately over the force-transmitting bolt 54 before the excavated earth is replaced so that a hollow access opening is defined by the tube 60 which may be used at a later time to adjust the load carried by the anchor shaft.

The tube 60 extends to an above-ground position and includes a cap 62 that prevents dirt or foreign matter from getting into the tube 60.

When it is desired to adjust the load on the anchor shaft 20, the cap 62 is removed and a wrench (not shown) is inserted into the tube 60 to a position in which it engages the force-transmitting bolt 54. Thereafter, the wrench is turned to cause adjustment of the position of the bolt 54 relative to the bracket assembly 18.

By providing this feature of the invention, numerous advantageous results are realized. For example, by permitting subsequent adjustment of the load carried by each of the anchor shafts around a house, it is possible to accommodate settling of the earth beneath the foundation.

DESCRIPTION OF ANOTHER EMBODIMENT OF THE INVENTION

Figure 7:
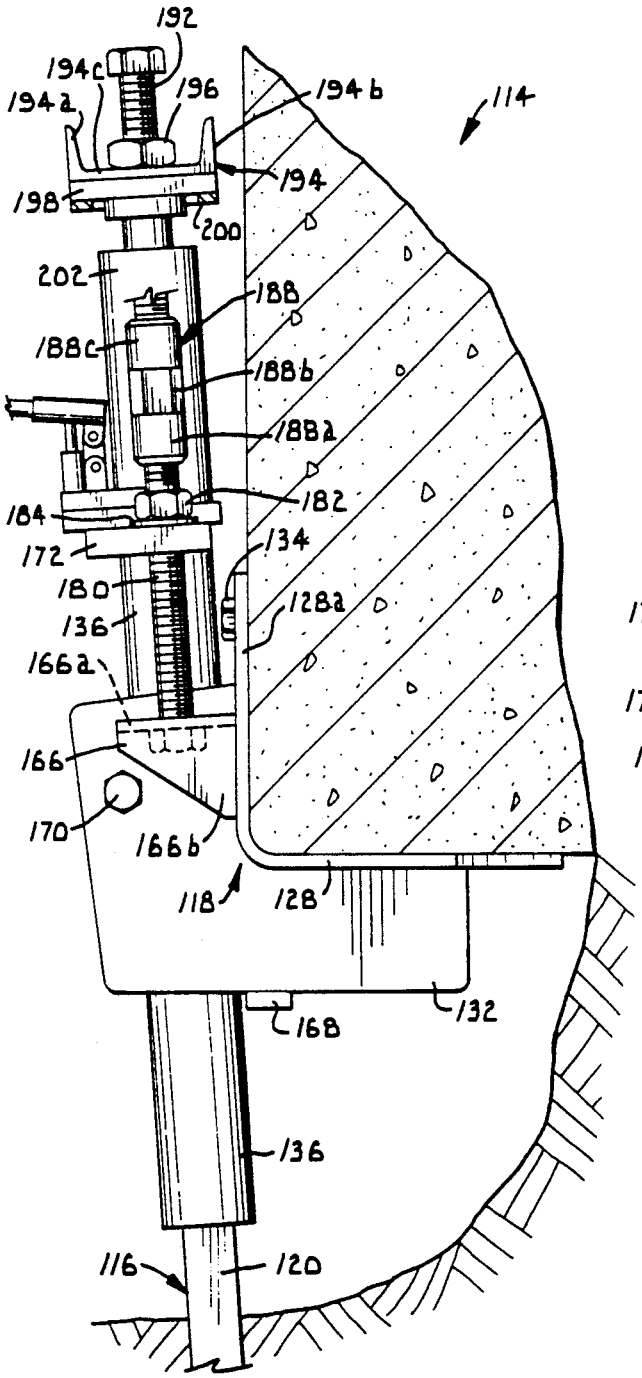
FIG. 7 is a front elevational view of a modified support bracket embodying the concepts of the present invention.
Figure 8:
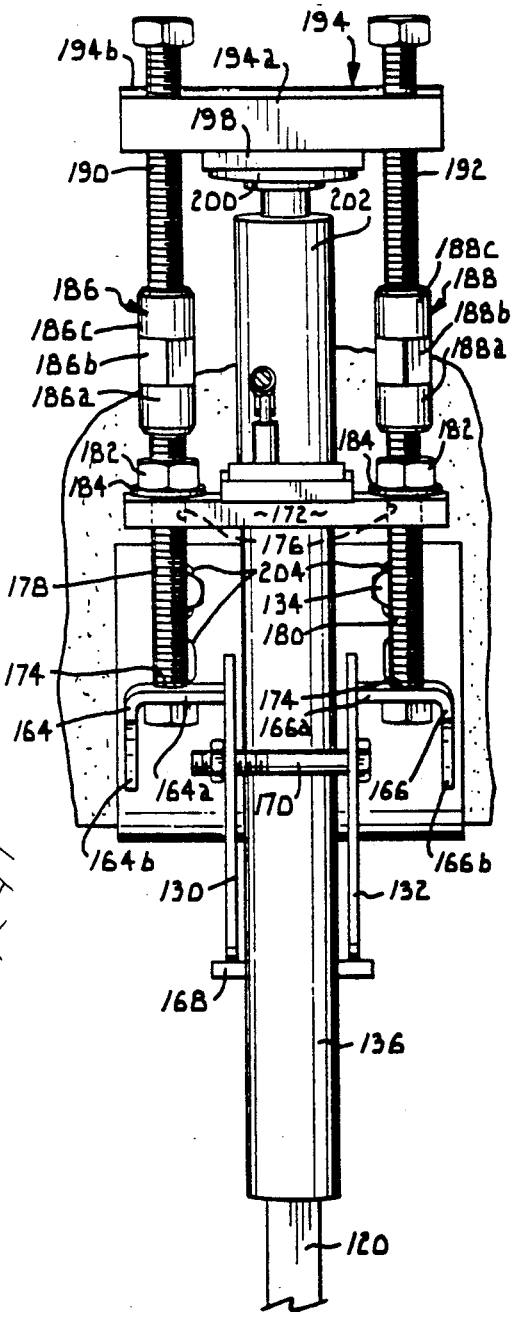
FIG. 8 is a side elevational view of the modified support bracket of FIG. 7.

A further embodiment of the invention, and which is preferred in certain instances is illustrated in FIGS. 7 and 8.

As shown in FIG. 7, each anchoring assembly broadly designated 114 includes an earth anchor 116 identical to or similar to anchor 16, as well as a foundation support or bracket assembly 118 which differs from the bracket 18 but performs an essentially equivalent foundation support function.

As shown in FIGS. 7 and 8, the bracket assembly 118 includes an L-shaped foundation-engaging plate 128 having a pair of spaced apart, generally parallel apertured walls 130 and 132 secured to the convex face thereof. Plate 128 is also adapted to engage the lower external edge of a foundation 10 and to be permanently attached thereto by suitable bolts in the same fashion as previously described with respect to bracket assembly 18.

Two normally horizontally spaced, inverted L-shaped members 164 and 166 are welded to the upright leg **128*a* of plate 128 as best shown in FIG. 7 with the uppermost, horizontal leg segments 164*a* and 166*a* thereof also being welded to the outer faces of upright walls 130 and 132. An elongated tubular member 136 is positioned between opposed inner faces of walls 130 and 132 and is adapted to be telescoped over the upper end of screw anchor shaft 120 upon installation of the bracket assembly 118. A cross piece 168 welded to the lower margins of walls 130 and 132 intermediate the ends of such edges serves as a backstop for member 136 while a bolt 170 extending through suitable aligned openings in walls 130 and 132 adjacent the upper portions thereof, acts as a restraining device for the member 136 within the confines of L-shaped members 164 and 166. A cross plate 172 welded to the upper end of tubular member 136 and of a length only slightly less than the width of the plate 128 overlies the generally horizontal legs 164*a* and 166*a* of L-shaped members 164 and 166**.

The legs **164*a* and 166*a* of members 164 and 166 have openings 174 therein which are normally aligned with similarly sized openings 176** in opposed ends of cross plate 172. If desired, during punching of the openings 174, the surrounding surface of legs 164*a* and 166*a* respectively may be formed downwardly to present substantially semispherical surfaces surrounding corresponding openings. Inverted threaded bolts 178 and 180 extend upwardly through respective openings 174 and aligned openings 176 of cross plate 172. As is most evident from FIG. 7, the heads of such bolts 178 and 180 underlie and engage the bottom surfaces of the legs 164*a* and 166*a* of members 164 and 166. The semispherical surfaces of legs 164*a* and 166*a* around corresponding openings 174 allows some movement of bolts 178*a* for alignment purposes with respect to the member 136 and plate 172 thereon.

Nuts 182 are threaded over each of the bolts 178 and 180 above cross plate 172 with washers 184 being provided between each of the nuts 182 and the cross plate 172.

Two special jacking nuts 186 and 188 have right-hand threaded passages in the normally lowermost ends 186*a* and 188*a* thereof for threaded receipt of the upper ends of respective bolts 178 and 180. The central sections 186*b* and 188*b* are formed to present wrench-receiving flats to facilitate rotation of such jacking nuts. The upper extremities 186*c* and 188*c* also have axial right-handed internally threaded passages for receipt of corresponding threaded bolts 190 and 192 respectively which project upwardly and are axially aligned with bolts 178 and 180.

A cross channel broadly designated 194 is positioned directly above cross plate 172 and has two upstanding legs 194*a* and 194*b* integral with a lower bottom wall 194*c*. In order to accommodate the threaded bolts 190 and 192, the bottom wall 194*c* of channel 194 has a pair of openings 194*d* therethrough and spaced such that they will axially align with the openings 176 through cross plate 172. Thus, the headed bolts 190 and 192 are adapted to extend through corresponding openings 194*d* and to thread into special jacking nuts 186 and 188 as shown in FIG. 7. Additional nuts 196 provided within the channel 194 are also threaded onto bolts 190 and 192 above the bottom wall 194*d* of the channel.

A reinforcement member 198 welded to the underside of wall 194*d* between bolts 190 and 192 reinforces wall 194*d* and also serves as a mount for an annulus 200. As best shown in FIG. 7, a jack 202 may be positioned between cross plate 172 and channel 194 with the ram 204 of such jack received within the annulus 200. Although the jack 202 as illustrated in FIG. 7 is depicted for exemplary purposes as being a hand actuated hydraulic unit, it is to be appreciated that such jack may be connected to a source of hydraulic pressure with the supply of hydraulic fluid being remotely controlled.

In the use of assemblies 114, the building structure to be stabilized is first inspected to determine its calculated weight or total dead load. Next, the installer makes a calculation of the anticipated live loads which are likely to be experienced by that building structure after stabilization of the foundation, depending upon the geographical locale of the building and the conditions of snow load, wind loads, persons habiting the structure, equipment or stock to be stored therein, and any other variable loads that are normally taken into account during determination of the assumed total live load. The perimeter of the foundation of the building structure to be stabilized is then measured so that the calculated combined dead weight and live load "w" of the building structure per lineal foot of foundation may be determined (lb/ft).

The installer next determines the total number of bracket assemblies 118, and establishes where such bracket assemblies should be located depending upon the dead weight and any live load "w" at specific locations around the perimeter of the building. For example, if it is found that a particular part of the building is calculated to have a greater combined dead weight and live load on the foundation than is the case with other parts of such building structure, the installer may determine that a greater number of bracket assemblies 118 in closer spaced relationship may be required for heavier perimeter portions of the building than is the case with other sections of such building around the perimeter thereof. In all instances though, it has been determined that the anchoring assemblies 114 should be spaced at intervals of no less than about 4 lineal feet along the foundation. If the assemblies 114 are spaced closer than about 4 feet apart, the screw anchors 116 of each assembly 114 can disturb the soil in surrounding relationship thereto to an extent radially from a respective anchor that the holding power of each anchor may thereby be comprised.

In determining the total number of anchor assemblies 114 "B" (unitless) required for stabilizing a building structure which may or has experienced settlement or movement, variables that must be taken into account include the combined dead weight and live load "w" of that structure, the lineal feet "x" along the foundation (ft), and the capacity "S" of each bracket assembly 118 (lb). For most applications, a typical bracket assembly 118 in this respect should have a rated capacity of at least about 15,000 lbs.

The total number of brackets required for a specific installation therefore may be determined in accordance with the formula $$B = \frac{w(x)}{S} \qquad \text{[II]}$$

The lineal spacing of anchor assemblies 114 may be calculated in accordance with the formula $$S_p = \text{spacing} = \frac{x}{B} \qquad \text{[III]}$$

As previously indicated, the earth around the foundation is excavated at each position where it has been determined that an anchoring assembly 114 should be located to properly stabilize the building foundation. If it is desired that a respective bracket assembly 118 be used as a guide for installation of a screw anchor 116 (by locating the shaft 120 between upright walls 130 and 132 of the corresponding bracket assembly 118), the bracket assembly 118 is bolted to the foundation or footing in a manner similar to that illustrated in FIGS. 4 and 5. For that purpose, plate 128 has a series of elongated openings 204 therein for receipt of anchor bolts.

After placement of the screw anchor in a respective excavated opening at an angle with respect to the vertical and with the shaft 120 properly positioned between walls 130 and 132, rotational torque is imparted to such screw anchor through torque applying means such as the hydraulic drive head as shown in FIG. 5. Sufficient rotational torque is imparted to each screw anchor as a force independent of a corresponding bracket assembly 118 and the foundation 10 until a value of at least about T = 500 lb-ft is achieved in accordance with the formula $$T = \frac{w(x)(S.F.)}{n(N)} \quad [8]$$

where, "w" = the calculated combined dead weight and live load of the building structure per lineal foot of foundation (lb/ft), "x" = lineal feet along the foundation (ft), "S.F." (safety factor) = at least 1.0, "n" = 8 to 20 (empirical multiplier for torque versus holding power of screw anchor, 1/ft.), and "N" = number of screw anchors and associated supports to be used in stabilizing the building structure determined by formula [II]. In most instances, it is desirable that screw anchors be employed having transversely square shafts of at least about 1½ inches across the flats. Similarly, the helices should have a minimum diameter of at least about 6 inches. Shaft dimensions of up to about 4 inches may be used with maximum helix dimensions of about 16 inches. Furthermore, multi-helix screw anchors may be used with the spacing between adjacent helices being anywhere from about 18 to as much as 42 inches. The rotational torque applied to the screw anchor should be at least about 1,500 ft-lb, and preferably at least about 2,000 ft-lb.

The safety factor (S.F.) in formula [I] expressed as a minimum of 1.0, preferably should be at least about 2.0. This means that if a weight "w" is to be stabilized using anchoring assembly 114, the assembly should be capable of supporting at least about 2w.

Upon reaching a predetermined rotational torque, such torque is released from the anchor that has been driven into the ground adjacent the foundation, and the anchor is then permitted to return to its unstressed state. This permits attachment of the screw anchor to the associated bracket assembly 118 without any rotational forces being translated from the screw anchor to the bracket that would tend to turn such bracket in a direction away from the foundation.

The tubular member 136 is then telescoped over the uppermost extremity of shaft 120 of the screw anchor 116 with the cross plate 172 coming to rest on the top of the shaft 120 with the member 136 located between walls 130 and 132 of bracket assembly 118 and adjacent the backstop 168. Bolt 170 is then threaded through the aligned openings therefor and walls 130 and 132 and the nut attached to trap the member 136 between bolt 170 and backstop 168.

The bolts 178 and 180 are inserted upwardly through legs 164*a* and 166*a* of L-shaped members 164 and 166 and through the openings 176 in cross plate 172 whereupon nuts 182 are threaded down onto respective uppermost ends of bolts 178 and 180. Special jacking nuts 186 are then threaded onto the uppermost ends of the bolts 178 and 180. Assuming that the bolts 190 and 192 have been passed through openings 194*d* in the bottom of 194*c* of channel 194 after placement of nuts 196 thereon, the lowermost ends bolts 19 and 192 are then threaded into the upper ends 186*c* and 188*c* of special jacking nuts 186 and 188. The spacing between cross plate 172 and channel 194 should be such that jack 202 may be placed between the cross plate 172 and plate 198 with the ram within annulus 200.

The installer then applies an upward force on channel 194 by operating the handle of the jack (or supplying hydraulic pressure from the remote source) to transfer this upward force to the channel 194. By virtue of the fact that the nuts 196 on bolts 190 and 192 engage the upper surface of the bottom 194*c* of the channel, the jacking force is transmitted directly to the L-shaped members 164 and 166 by the combination of bolts 190 and 192, jacking nuts 186 and 188 and associated bolts 178 and 180. This upward force is likewise transmitted to the bracket plate 128 which is applied directly to the foundation resting on bracket assembly 118. The force applied by jack 202 between cross plate 172 and channel 194 causes such members to tend to move relatively.

By virtue of the fact that the combined dead weight of the building and any live load at an anchor installation position is transferred to the screw anchor after rotational torque thereon has been relaxed, the installer of anchor assembly 114 is assured that the requisite support for the foundation is obtained in all instances. In past practices, where a piling is driven into the ground using hydraulic cylinders coupled to the piling, the fulcrum for the hydraulic cylinders is the foundation itself. Thus, the piling can only be driven to a depth allowed by the weight of the building. Accordingly, when the hydraulic cylinders are disconnected from the piling, there is no built-in safety factor preventing further settling of the pilings over time in that the maximum holding power was obtained at the time of installation when the weight of the building determine the holding power of the pilings. For example, when the moisture content of the soil surrounding the pile changes, the frictional resistance provided by the soil also changes. An increase or decrease in the moisture content of the soil surrounding the piling decreases the skin resistance of the piling. Accordingly, the building is free to again settle or move.

After the bracket assembly 118 has been lifted to a required extent or the force applied thereto brought to a requisite level, the nuts 182 are rotated in a direction to bring them into height engagement with the washers 184 resting on cross plate 172. This firmly affixes the screw anchor 116 to the bracket assembly 118.

Thereupon, the jack 202 may be withdrawn from its position between channel 194 and cross plate 172. Following that, the assembly made up of channel 194, bolts 190 and 192 and jacking nuts 186 and 188 may be removed from the bolts 178 and 180.

Another feature of anchoring assembly 114 is the fact that at some later time, if it is desired to again apply a force to the bracket assembly 118 to further stabilize the foundation, this can be accomplished by simply excavating the area where a particular bracket and screw anchor are located, mounting the U-shaped unit made up of channel 194, bolts 190 and 192 and jacking nuts 186 and 188 on bolts 178 and 180, reapplying an upward force on channel 194 with a jack inserted between such channel and cross plate 172, and thereafter removing the channel-bolt and jacking nut U assembly from the bracket 118. This procedure can be repeated as many times as necessary and can be carried out differentially along the length of the foundation.

Although the invention has been described with reference to preferred embodiments shown in the figures, it is noted that substitutions may be made and equivalents employed herein without departing from the scope of the invention as defined in the claims.

We claim:

1. A method of stabilizing the below-grade foundation of an existing building structure having a predetermined weight and an assumed live load, the method comprising the steps of:

providing a support for the foundation at each of a plurality of positions along the foundation;

positioning a screw anchor at each of the positions along the foundation to be stabilized with the supports, each screw anchor having an elongated anchor shaft presenting an earth-penetrating tip, a transversely extending load-bearing member secured to the anchor shaft, and an upper end opposite the tip;

rotating the shaft of each anchor to force the anchor into the earth below the foundation until the upper end of the anchor shaft is positioned adjacent the foundation; and thereafter connecting the upper ends of the anchor shafts to the foundation and transferring the dead weight and any live load of the building structure on the supports, to the screw anchors.

2. A method as set forth in claim 1, wherein is included the step of discontinuing the rotation of each screw anchor to permit the anchor to return to its unstressed state before transfer of the dead weight and any live load of the building structure on the supports, to the screw anchors.

3. A method as set forth in claim 2, wherein is included the steps of excavating the earth adjacent the foundation at each of said positions, and placing a support beneath the foundation at each such excavated position before transfer of the dead weight and any live load of the building structure to a respective screw anchor.

4. A method as set forth in claim 3, wherein the screw anchors are driven into the earth adjacent the foundation at an angle with respect to the vertical with the lower part of the screw anchor in closer disposition to the foundation than the upper part of each such anchor.

5. A method as set forth in claim 4, wherein is included the step of placing a support beneath the foundation at each of said positions which has a foundation supporting part underlying the foundation, and an upright part at an angle with respect to the vertical which is essentially equal to the angle of the installed screw anchor.

6. A method as set forth in claim 2, wherein is included the step of placing supports and associated screw anchors along the foundation at intervals of no less than about 4 lineal feet.

7. A method as set forth in claim 2, wherein is included the step of raising the foundation and thereby the building structure at one of the supports while such support rests on and is carried by the associated screw anchor.

8. A method as set forth in claim 7, wherein the step of raising the foundation and thereby the building structure while resting on a respective support is accomplished by applying a force acting in opposite directions between the screw anchor and a respective support.

* * * * *